United States Patent [19]

Drouin

[11] Patent Number: 4,862,431

[45] Date of Patent: Aug. 29, 1989

[54] CIGARETTE CASE WITH BUILT IN ELECTRONIC TIMING DEVICE

[76] Inventor: Richard Drouin, 82-15 134th St., Kew Gardens, N.Y. 11435

[21] Appl. No.: 200,719

[22] Filed: May 27, 1988

[51] Int. Cl.[4] ..... G04B 47/00; A24F 15/14

[52] U.S. Cl. ..... 368/10; 431/285; 131/270

[58] Field of Search ..... 131/270; 368/10, 221; 431/285

[56] References Cited

U.S. PATENT DOCUMENTS

| | | | |
|---|---|---|---|
| 2,613,527 | 10/1952 | Harris | 131/270 |
| 2,681,560 | 1/1957 | Shuttleworth et al. | 131/270 |
| 3,424,123 | 1/1969 | Giffard | 131/27 |
| 4,076,118 | 2/1978 | Karlsson | 131/270 |
| 4,084,415 | 4/1978 | Corman | 368/221 |
| 4,615,681 | 10/1986 | Schwarz | 131/270 |

FOREIGN PATENT DOCUMENTS

| | | | |
|---|---|---|---|
| 3139184 | 4/1983 | Fed. Rep. of Germany | 131/270 |

*Primary Examiner*—Bernard Roskoski
*Attorney, Agent, or Firm*—Michael I. Kroll

[57] ABSTRACT

A cigarette case with built in electronic timing device is provided that aids in the withdrawal from cigarette smoking. When the user loads cigarettes into the case he sets a timing interval. After this interval the case emits a pleasing beeping sound signalling him that it is permissible to open the case cover and remove and smoke another cigarette. If he attempts to open the cover prematurely, a loud irritating alarm is set off. The elapsed time is displayed at all times. In an alternative embodiment, the cigarette case will not open until the preset time has elapsed.

2 Claims, 1 Drawing Sheet

CIGARETTE CASE WITH BUILT IN ELECTRONIC TIMING DEVICE

BACKGROUND OF THE INVENTION

The present invention relates generally to the field of health maintenance, and, more specifically, to the elimination of cigarette addiction through the gradual reduction in the number of cigarettes smoked each day.

The U.S. Surgeon General, the National Institute of Health, and various medical research societies have all reached the conclusion that smoking is the leading cause of preventable death in this country. Smoking is held responsible for the high incidence of cardio vascular disease, cancers of the lungs and respiratory system, and low birth weights of newborns. Warning labels are attached to all cigarette packages and advertising for cigarettes is banned from the broadcast media. Smoking in public areas is rapidly being restricted.

Cigarette smoking is an addiction with nicotine the primary chemical addictive substance. As with all chemical addictions, it is very difficult to cease consumption all at once. Such a cold turkey approach produces powerful cravings that are likely to result in the resumption of the addictive behavior. Instead, a gradual withdrawal produces tolerable side affects and is self reinforcing. Decreasing cigarette consumption over a period of time requires an inordinate amount of attention on behalf of the smoker: he must closely monitor the time at which he smokes.

SUMMARY OF THE INVENTION

It is, therefore, a primary object of the instant invention to provide a cigarette case with built in electronic timing device that alerts the smoker when withdrawing a cigarette from the case is permitted.

Another object is to provide a cigarette case with built in electronic timing device that only allows him to reset the interval after all of the cigarettes in the pack have been withdrawn, thereby preventing him from resetting the interval at whim.

Yet another object is to provide a cigarette case with built in electronic timing device that displays the time that has elapsed since the withdrawal of the previous cigarette as well as the preset interval as well as the amount of cigarettes smoked on display screen.

Yet another object is to provide a cigarette case with built in electronic timing device that displays the number of times the cover is opened to remove a cigarette.

Still another object is to provide a cigarette case with built in electronic timing device that produces a loud irritating alarm if the case cover is opened too early: before the end of a time interval.

Another object is to provide an optional embodiment of cigarette case with built in electronic timing device that prevents the case from being opened before the end of the preset time interval.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
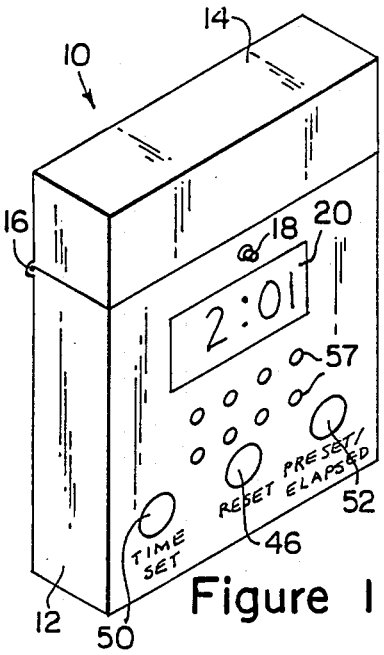
FIG. 1 is a perspective view of the invention illustrated with cover closed.
Figure 2:
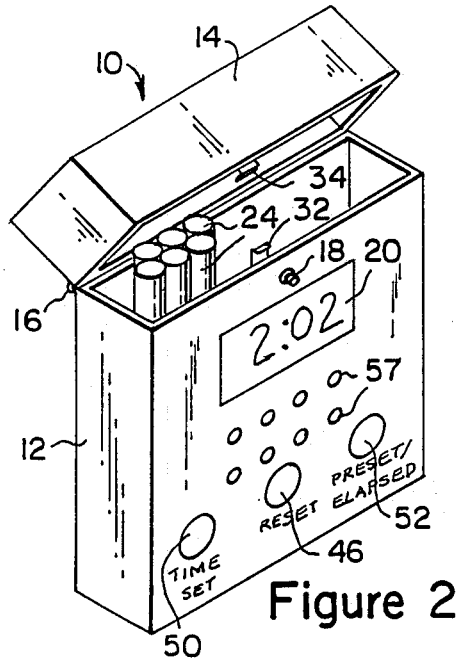
FIG. 2 is a similar perspective view as in FIG. 1 but with the cover shown open exposing the cigarettes contained therein.
Figure 3:
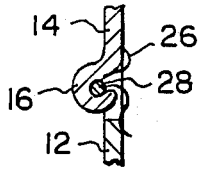
FIG. 3 is a detailed partial end view of the spring loaded hinge assembly connecting the housing to the cover.
Figure 4:
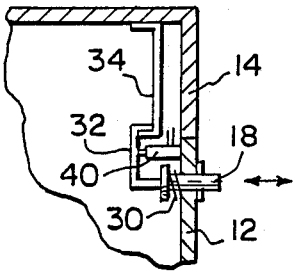
FIG. 4 is a detailed partial cutaway plan view showing the latching system of one embodiment of the invention.

The cigarette case 10 comprises two main elements: housing 12 and cover 14 hinged at 16 by hinge rod 28. In use, an entire pack of cigarettes, typified by 24, are loaded into housing 12 and cover 14 is closed. When cover 14 is closed this activates cigarette case switch 40 which initiates a divide by n circuit, typified by divide by 20 circuit 42, where n is the number of cigarettes in a single package, i.e. 20. Reset enable circuit 44 then allows reset button switch 46 to rest the interval of timer circuit 48.

Once the user has installed a new package of cigarettes and closed cover 14, he then depresses reset button switch 46 resetting the interval to zero. Next he depresses time set switch button 50 and watches the time interval advance on display 20, typically a liquid crystal display (LCD). Time set switch button 50 is released when the desired time is reached.

The first time he desires a cigarette the user depresses opening button 18, which is biased forward by coiled spring 30. Button 18, is attached to a hook-shaped lock end component 32, which engages hook end component 34 which is attached to cover 14. When button 18 is depressed, lock end 32 and hook end 34 disengage so cover 14 can be opened. When cover 14 is opened for this first time, reset enable circuit 44 is disabled so that timer reset button 46 is disabled and will stay disabled until the last cigarette, i.e. the 20th cigarette, has been withdrawn by opening cover 14 twenty times. Cigarette case switch 40 also starts timer 48 so that the elapsed time is indicated on display 20. The user may toggle between the elapsed time and the preset time interval by alternately depressing preset/elapsed time button switch 52 so that the user may determine the time remaining until he smoke the next cigarette.

At the end of the preset time interval, alarm logic circuit 54 activates OK TO SMOKE alarm 56 which emits a pleasant beeping sounding through a series of holes typified by 57. The user then depresses opening button 18, withdraws a cigarette, and closes cover 14, starting the count cycle again. Every time cover 14 is opened and closed the counter is reset to zero count and resumes the count up to the preset interval. Alternately, the counter may be configured such that it is reset to the predetermined time interval and begins counting backwards towards zero so that the user may quickly determine the time left until the next cigarette.

If the user attempts to open cover 14 before the end of the preset interval, alarm logic circuit 54 signals NOT OK TO SMOKE alarm 58 which emits a shrill irritating noise through the same series of holes typified by 57.

Figure 5:
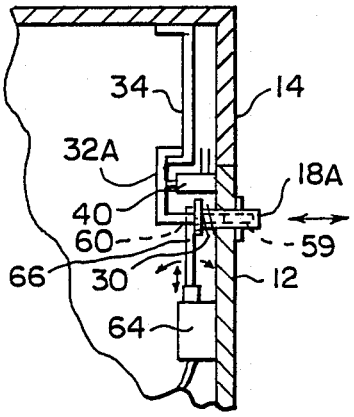
FIG. 5 is a similar view to FIG. 4, but showing an alternative embodiment that prevents the case from being opened prior to the completion of the preset time interval; and, FIG. 6 is an electronic block diagram illustrating both embodiments of the invention.
Figure 6:
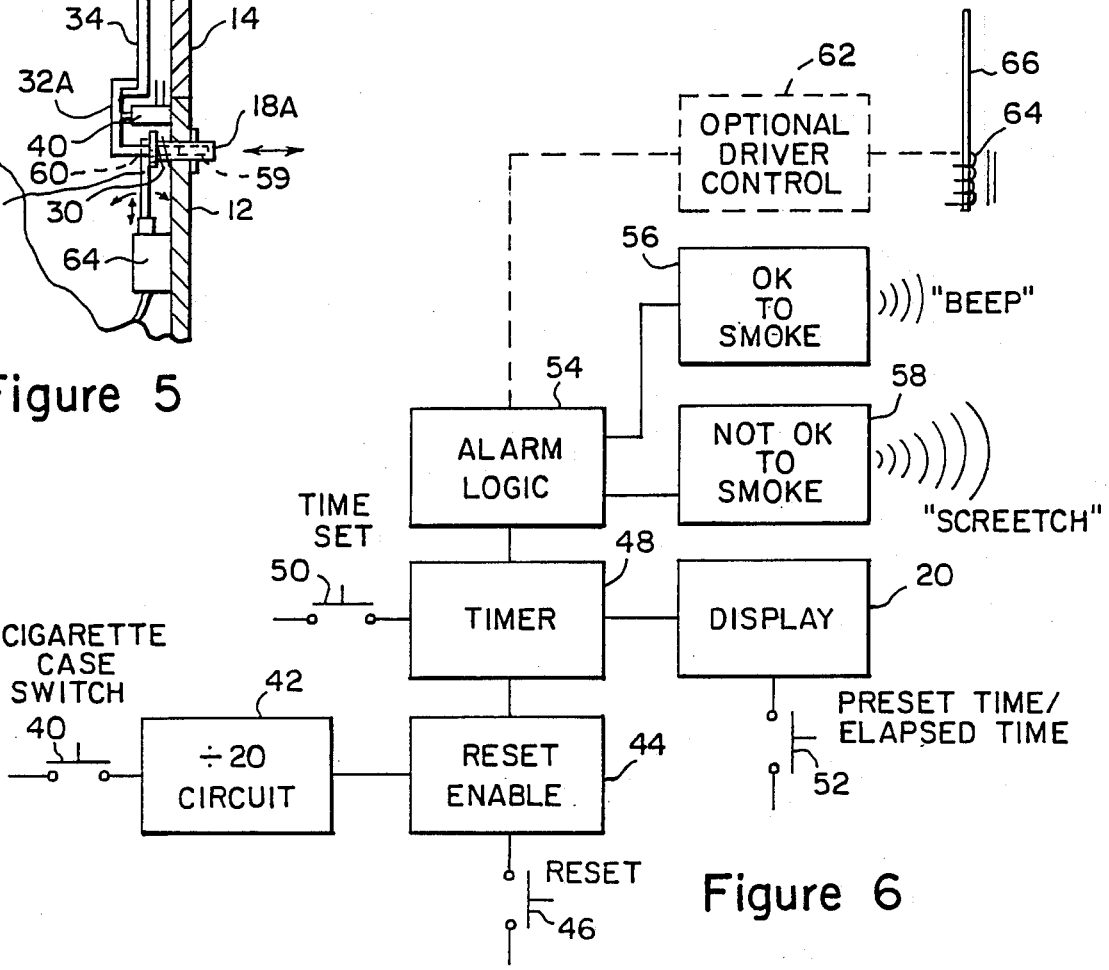

In an alternative embodiment, illustrated in FIGS. 5 and 6, the user is actually prevented from opening the cover 14 before the end of the preset time interval. Opening button 18A now has a hollow recess and lock end 32A, instead of being fixedly attached to the button, can slide in and out of the recess in opening button 18A. If allowed to slide in this manner, opening button 18A will not cause lock end 32A to travel to the right when button 18A is depressed and cover 14 will remain closed. However lock end 32A has an aperture through which a pin may pass. When such a pin is inserted through aperture 60 then depressing opening button 18A will cause cover 14 to open. In this embodiment an optional driver control circuit 62 energizes optional cover latch solenoid 64 at the end of each time interval. Solenoid 64 forces flexible pin 66 into aperture 60 in lock end 32A enabling opening button 18A. Pin 66 flexes when button 18A is depressed. Therefore, after the preset time interval depressing button 18A will open cover 14.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A cigarette case having a built in timing device, comprising:

(a) a rigid housing having a substantially rectangular cross section with a pair of short sides and a pair of long sides and into which can be inserted a conventional package of cigarettes;

(b) a cover that surmounts said housing and also having a pair of short sides and a pair of long sides;

(c) a spring loaded hinge affixed to a long side of said pair of long sides of said housing and a long side of said pair of long sides of said cover so that when said cover is hinged to its open position cigarettes can be withdrawn from said housing;

(d) means disposed on other long side of said pair of long sides of said housing for latching said cover into its normally closed position and for unlatching said cover to permit the withdrawal of cigarettes, said means for latching said cover into its normally closed position and unlatching said cover to permit the withdrawal of cigarettes include an opening button that protrudes through said other long side of said pair of long sides of said housing; a coiled spring biasing said opening button toward said other long side of said pair of long sides of said housing; a hook-shaped lock end component attached to said opening button; and a hook end component attached to said cover such that in the normally closed configuration said hook end and said lock end are engaged so that to open said cover said opening button is depressed therefor disengaging said hook end and said lock end and allowing said cover to be opened;

(e) interval timing means being disposed internally to said housing and including a speaker, said timing means may be set to produce an audible noise after each user-definable preset time interval alerting a user that it is permissible to withdraw a cigarette, and that said timing means produces a louder, irritating noise, if said user withdraws a cigarette prior to the end of a timing interval, said interval timing means include an electronic timer; a time set button switch that sets the interval of said timer; a cigarette case switch activated each time said cover is opened; a divide by n circuit where n is the number of cigarettes in a package of cigarettes so that n activations of said cigarette case switch causes said divide by n circuit to yield an output; a reset button switch; a reset enable circuit to which said reset button switch and said divide by n circuit are connected such that said reset button switch can reset said timer interval only after said cover has been opened n times and therefor preventing a user from resetting said interval at whim; a numeric display; a preset time/elapse time button switch connected to said numeric display such that said time button switch determines whether said numeric display shows the preset time interval or the time elapesed since the last opening of said cover; an OK to smoke audible alarm that emits a pleasing noise through said speaker disposed internally to said housing; a NOT OK to smoke audible alarm that emits a loud irritating noise through said speaker disposed internally to said housing; and alarm logic that interfaces between said electronic timer and both of said alarms such that said alarm logic activates said OK to smoke alarm after each preset time interval and similarly activates said NOT OK to smoke alarm if said cover is opened before the completion of a time interval; and (f) a display that is disposed internally to said housing and reports to said user definable preset time internal and also the time elapsed since the withdrawal of the last cigarette.

2. A cigarette case having a built in timing device, comprising:

(a) a rigid housing having a substantially rectangular cross section with a pair of short sides and a pair of long sides and into which can be inserted a conventional package of cigarettes;

(b) a cover that surmounts said housing and also having a pair of short sides and a pair of long sides;

(c) a spring loaded hinge affixed to a long side of said pair of long sides of said housing and a long side of said pair of long sides of said cover so that when said cover is hinged to its open position cigarettes can be withdrawn from said housing;

(d) means disposed on other long side of said pair of long sides of said housing for latching said cover into its normally closed position and unlatching said cover to permit the withdrawal of cigarettes, said means for latching said cover into its normally closed position and unlatching said cover to permit the withdrawal of cigarettes include a hollow opening button that protrudes through said other long side of said pair of long sides of said housing; a coiled spring biasing said opening button toward said other long side of said pair of long sides of said housing; a hook-shaped lock end component that moves slidably inside said hollow opening button and the slidable portion of said hook-shaped lock end component has an aperture through which a pin may be inserted; and a hook end component attached to said cover such that in the normally closed configuration said hook end and said lock end are engaged so that to open said cover a pin must be inserted through said aperture in said lock end component and said hollow opening button is then depressed, and disengaging said hook end and said lock end and then allowing said cover to be opened;

(e) interval timing means being disposed internally to said housing and including a speaker, said timing means may be set to produce an audible noise after each user-definable preset time interval alerting a user that it is permissible to withdraw a cigarette and that said timing means prevents the opening of said cover prior to the completion of a timing interval, said interval timing means include an electronic timer; a time set button switch that sets the interval of said timer; a cigarette case switch activated each time said cover is opened; a divide by n circuit, where n is the number of cigarettes in a package of cigarettes so that n activations of said cigarette case switch causes said divide by n circuit to yield an output; a reset button switch; a reset enable circuit to which said reset button switch and said divide by n circuit are connected such that said reset button switch can reset said timer interval only after said cover has been opened n times therefor preventing a user from resetting said interval at whim; a numeric display; a preset time/elapse time button switch connected to said numeric display such that said time button switch determines whether said numeric display shows the preset time interval or the time elapsed since the last opening of said cover; an OK to smoke audible alarm that emits a pleasing noise through said speaker disposed internally to said housing; a cover latch driver and a cover latch solenoid both connected to the output of said driver; a flexable pin that is displaced laterally by said solenoid and that when said solenoid is activated said flexible pin is inserted through said aperture in said hook end and permitting said opening button to open said cover; and alarm logic that interfaces between said electronic timer and said OK to smoke alarm and said solenoid driver so that said alarm logic activates said OK to smoke alarm after each preset time interval and similarly prevents the opening of said cover at any time prior to the completion of a time interval; and (f) a display that is disposed internally to said housing and reports to said user definable preset time internal and also the time elapsed since the withdrawal of the last cigarette.

* * * * *